United States Patent [19]

Casper

[11] 3,995,851

[45] Dec. 7, 1976

[54] DOCUMENT JOGGER TRANSPORT

[75] Inventor: Mark S. Casper, Grosse Pointe, Mich.

[73] Assignee: Burroughs Corporation, Detroit, Mich.

[22] Filed: Oct. 2, 1975

[21] Appl. No.: 618,929

[52] U.S. Cl. ..... 271/179; 271/210

[51] Int. Cl.[2] ..... B65H 29/42

[58] Field of Search ..... 271/179, 210

[56] References Cited

UNITED STATES PATENTS

| | | | |
|---|---|---|---|
| 441,832 | 12/1890 | Ethridge | 271/179 |
| 1,576,243 | 3/1926 | Mentges | 271/179 |
| 2,970,836 | 2/1961 | Smith | 271/179 |
| 3,847,382 | 11/1974 | McKee | 271/179 X |

*Primary Examiner*—Richard A. Schacher
*Attorney, Agent, or Firm*—Richard Jordan; Kevin R. Peterson

[57] ABSTRACT

A document feeding apparatus is provided which includes a hopper for holding a stack of documents edgewise, feed means for serially removing documents from the hopper, and a follower or pressure flag for biasing the stack towards the feed means. Augers are disposed within the hopper adjacent the feed means for advancing the stack thereto, and for aligning or jogging the documents in an intermediate area thereof. The diameter and pitch of the threads of the augers increase from leading ends thereof towards their center sections, and decrease from the center sections towards the trailing ends thereof. The narrow-pitched threads at the leading ends of the augers serve to divide the document stack into packs. The widening pitch of the augers allows the documents to spread apart in the center sections, thereby reducing interdocumental pressure and friction and allowing the documents to be jogged and properly aligned relative to the base and a front edge guide of the hopper. The decreasing thread pitch of the augers adjacent the document feed means serves to compress the packs to present a firmly packed stack of documents to the feed means.

10 Claims, 3 Drawing Figures

DOCUMENT JOGGER TRANSPORT

BACKGROUND OF THE INVENTION

1. Field of the Invention

The invention disclosed herein relates generally to the field of sheet-feeding and more specifically to apparatus for moving edge-stacked documents through a hopper and into serial frictional contact with a document feeding means and for effecting this movement while jogging and mutually aligning the stacked documents.

2. Description of the Prior Art

A document feeding apparatus employing the principles of the disclosed invention forms part of a document reader-sorter which provides for the automatic reading of data recorded on documents such as bank checks, and for the automatic sorting of the documents according to the date recorded thereon. A stack of documents is manually placed edgewise into a document hopper, from which individual documents are serially fed at high speed by feed means along a tranport guideway. The documents travel past a reading station where a read head reads the indicia recorded on each document and selects one of a plurality of pockets into which the document is to be deposited. A more detailed description of such document feeding apparatus is provied in U.S. patent application Ser. No. 554,579, filed Mar. 3, 1975, such application being assigned to the assignee of the present application.

In document feeding apparatus of the type briefly descried supra, document feeding from the hopper requires that the documents be brought into mutual alignment along their bottom and forward edges prior to their being presented to the document feed means. Heretofore this has commonly been accomplished by means of a separate jogger that shakes the edge-stacked documents into such mutual alignment. Stacks of mutually aligned documents are then carefully removed from the separate jogger and transported and placed in the hopper. This procedure has been deemed wasteful in that it requires the use of a device of separate entity, and involves the extra step of preliminary jogging followed by careful removal of the documents to the hopper of the document feeding apparatus.

U.S. Pat. No. 3,240,489, issued to Pinckney et al, on March 15, 1966, provides for the incorporation of a jogging device within a leading section of the hopper, thereby eliminating the requirement of a separate device and the task of carefully transporting the documents from the jogger to the hopper. The hopper taught by Pinckney is hinged on one side and is struck towards the other side to produce vibrations that serve to jog the documents into mutual alignment. Pinckney et al also disclosed the use of a constant pitch auger in the downstream section of the hopper for dividing the documents into packs, and for maintaining the interdocumental pressures within each pack independently of the variable interdocumental pressures that might occur in the upstream section of the hopper.

The use of augers having a constant pitch to move documents is well known in the art. Another example, in addition to Pinckney, is U.S. Pat. No. 3,078,089 issued to Maidment on Feb. 19, 1963, in which an auger having a variably-diametered thread moves checks from one side of a storage pocket to another. U.S. Pat. No. 3,193,280 issued to Gutierrez on July 6, 1975 discloses an auger for intercepting mail envelopes traveling along a first path and for stacking and directing them toward a feeding means for removal along a second path.

SUMMARY OF THE INVENTION

It is a primary object of this invention to provide document feeding apparatus that incorporates auger means within the hopper compartment thereof, the auger means serving first to relieve the interdocumental pressure within the stack so that the documents therein may be aligned or jogged with minimal vibratory excitation of the hopper, and then to generate sufficient interdocumental pressure in that portion of the stack adjacent the feed means to facilitate efficient feeding of the documents.

It is another object of this invention to utilize augers of variable pitch and diameter as a means of first relieving and then regenerating interdocumental pressure within the stack of documents in the hopper.

It is still another object of this invention to provide a document feeding apparatus having a selfcontained jogger, and wherein the documents are jogged concurrently with their advancement through the hopper to the feed means.

Yet another object of the present invention is to provide document feeding apparatus that incorporates control means whereby the pressure of the stacked documents against the feed means is maintained within predetermined limits.

The invention disclosed herein comprises a hopper for holding edgewise a stack of documents, document feed means disposed at one end of the hopper for serially removing individual documents from the hopper, a follower or pressure flag for biasing the documents into frictional contact with the document feed means, and auger means within the hopper for separating the documents into packs and for joggably relieving the frictional force between the documents in the packs concurrently with the advancement of the packs to the document feed means. The diameter and pitch of the helical convolutions of the augers increase from one end towards the center, and then decrease towards the other end. The augers initially serve to separate the stack of documents in the hopper into packs, each pack being defined by the narrow diameter and pitch of the threads of the augers at the extremities remote from the feed means. As the augers rotate, the packs are advanced to the wider-pitched portions of the augers, where the spacing between the documents is allowed to increase and to thereby decrease the interdocumental pressure and friction within the packs, the documents within the packs being thereby rendered susceptible to a minimal vibrating force applied to the base and front edge guide of the hopper to be joggably aligned therewith. The pitch and diameter of the augers decrease as the documents within each pack near the document feed means, the packs being reunited into a firmly compressed stack of documents that is presented to the document feed means.

BRIEF DESCRIPTION OF THE DRAWING

The aforementioned objects and features of the present invention, as well as other objects and advantages thereof, will be better understood upon consideration of the following detailed description when read in conjunction with the accompanying drawing figures, in which.

DETAILED DESCRIPTION OF THE PREFERRED EMBODIMENT

Figure 1:
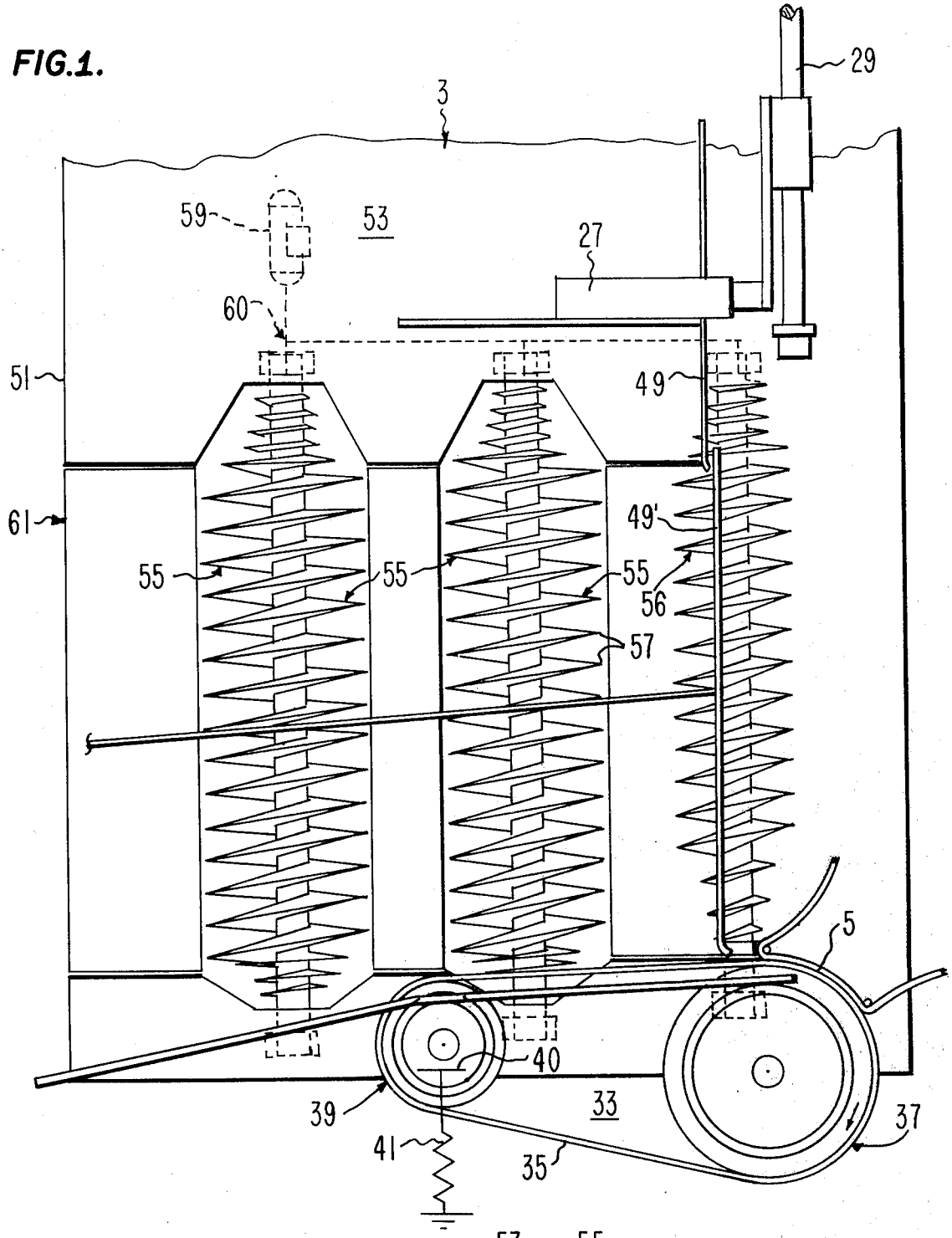
FIG. 1 is a plan view of the disclosed document jogger transport having a pair of variably pitched and diametered augers disposed for cooperation with the bottom edges of the documents and an elevated auger disposed for cooperation with the left edges of the documents.
Figure 2:
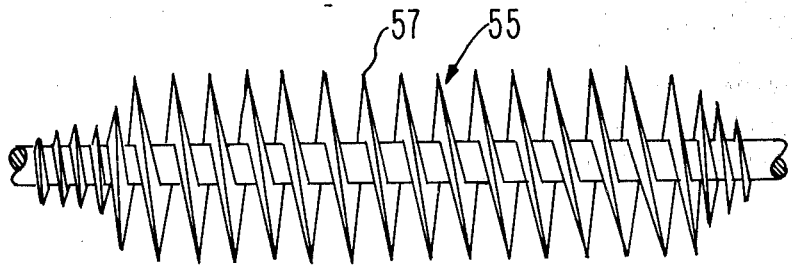
FIG. 2 is an elevational view of one of the bottom-edge augers illustrated in FIG. 1.

The inventive document feeding apparatus shown in FIG. 1 comprises a hopper 3 having a slightly inclined base 51 and front edge guides 49 and 49′ for guidably supporting a quantity of edge-stacked documents along the bottom and front (or left) edges thereof. Disposed at one end of the hopper is a document feed means, generally designated at 33, for serially picking documents from the hopper 3 and feeding them to a reader-sorter of which transport guideway 5 forms a part. The document feed means 33 is comprised of a belt 35 rotatably disposed around a drive pulley 37 and a spring-loaded idler pulley 39. The pulleys 37 and 39 are so positioned that the face of the belt 35 inboard of the hopper 3 is substantially parallel to the faces of the edge-stacked documents in the hopper.

The document handling apparatus illustrated in FIG. 1 may also include a follower or pressure flag 27 for providing a nominal biasing force against the document stack. The flag 27 would serve to contact the rearmost document in the stack, urging it towards the document feed means 33. The flag 27 may be mechanically loaded, as for example by a spring or hanging weight, such spring or weight producing a constant biasing force throughout the range of travel of the flag 27 along a support rod 29.

The base 51 includes a loading area 53 and a vibratile base portion 61 which is provided with two or more identical augers 55 that are coplanarly disposed relative thereto for cooperation with the bottom edges of the documents in the hopper. An elevated auger 56 is mounted in parallel relationship with the augers 55 for cooperation with the left (front) edges of the documents. The loading area 53 serves to receive a stack of documents in edgewise orientation. Each of the augers 55 is provided with a helical thread 57 the pitch and diameter of which are relatively small in a pick-off area of the hopper adjacent the loading area 53, which constitutes a first portion of the auger, and similarly relatively small in a drop-off area adjacent the feed means 33, which constitutes a third portion. The pitch and diameter of the thread of the auger 56 are likewise relatively small in a first portion adjacent to the pick-off area of the hopper, and the diameter thereof is relatively small in a third portion adjacent to the drop-off area adjacent the feed means. The pitch and diameter of the threads of the augers 55 and 56 are dimensionably greater in the intermediate areas of the augers which constitute second portions of the respective augers.

With reference to FIG. 1, the augers 55 and 56 are rotationally driven by conventional gearing designated at 60 and a direct current motor represented at 59, both being positioned beneath the base portion 51. The augers 55 and 56 are synchronously rotated by the motor 59, and in such direction that edge-stacked documents disposed between adjoining threads thereof are urged in the direction of the edge guide 49′, such urging in combination with the application of a minimal vibratory force to the base portion 61 and to the edge guide 49′ serving to joggably dispose the documents into abutting relationship with said base portion 61 and edge guide 49′ when the frictional pressure between the documents is relieved in the intermediate area of the augers. Means for vibrating the base portion 61 and edge guide 49′ are well known in the art and are not considered to form a part of the present-invention.

Figure 3:
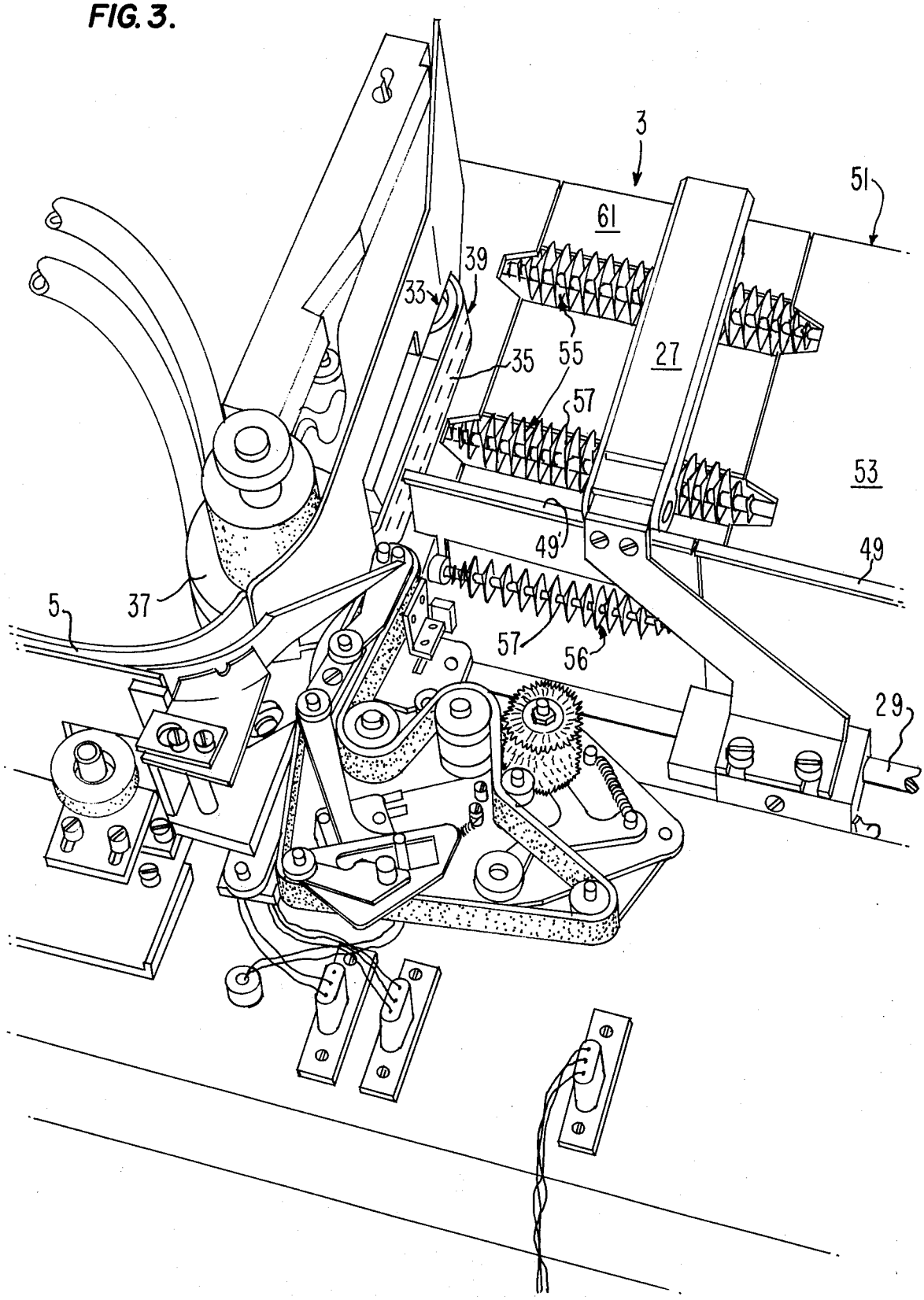
FIG. 3 is a perspective view of a document feeding apparatus incorporating the variably pitched and diametered augers illustrated in FIGS. 1 and 2.

The document handling apparatus illustrated in FIGS. 1 and 3 is also provided with pressure sensing and switching means effective for stopping the rotation of the augers 55 and 56 when the pressure of the documents against the feed means 33 exceeds a predetermined limit. It is to be noted in FIG. 1 that the idler pulley 39 is biased in the direction of the hopper 3 by a spring 41, and that a pressure switch 40 is disposed in cooperating relationship with the spring. In accordance with this arrangement, pressure in excess of the predetermined limit applied by the documents against the idler pulley 39 would have the effect of overcoming the bias of the spring 41 and of tripping the pressure switch 40, the motor 59 being thereby stopped from rotating the augers 55 and 56 until the pressure of the documents against the idler pulley 39 is again reduced below the predetermined limit.

Typical document handling apparatus incorporating the herein-described document jogger transport is shown in FIG. 3, such apparatus being similar to that disclosed in the aforementioned patent application Ser. No. 554,579. It is to be understood, however, that the disclosed document jogger transport may be utilized in transport apparatus other than that disclosed in the referenced application.

The operation of the invention will now be described. Documents such as bank checks are stacked edgewise in the loading area 53 of the hopper 3, with the bottom long edges thereof abutting the base portion 51 and the left edges thereof abutting the front edge guide 49. The follower 27 is placed behind and in contact with the rearmost document in the stack. The stack of documents is divided into separate packs by the helical thread 57 of the augers 55 and 56, the narrow-pitched helical convolutions of the thread adjacent the loading area 53 defining the successive packs. The packs are serially advanced by the rotation of the augers 55 and 56 and the urging of the pressure flag 27 towards the intermediate portions of the augers, where the increased pitch of the convolutions of the threads allows the documents within the packs to spread apart, thereby reducing the friction between the documents in the packs and allowing the documents to be joggably aligned relative to the base portion 61 and the front edge guide 49′, the latter alignment being contributed to by the vibrating excitation of the slightly inclined base portion 61 and the rotatable urging of the threads 57 of the augers.

Following the joggable alignment of the documents in the separate packs in the intermediate portions of the augers 55 and 56, the packs are again compressed by the narrow-pitched convolutions of the augers 55 in the area adjacent the feed means 33, and gradually joined together by the reduced diameter of the convolutions in such area to thereby present a firmly packed stack of documents to the feed means 33. The reduced pitch of the thread convolutions of the augers 55 and 56 permits the stacked documents in the loading area 53 to be divided into packs and advanced along the base portions 51 and 61 in the direction of the feed means 33, such process being enhanced and facilitated by the reduced diameter of the convolutions in the pickoff area. The increased diameter of the convolutions in the intermediate area of the augers 55 and 56 serves to sectionally support the packs during their said joggable alignment within the wider-pitched thread convolutions which characterize the intermediate area of the augers.

The current to the motor 59 is preferably limited to a value below the maximum rated stall current, thereby limiting the torque that the motor can deliver. This provides a uniform force between the feed means 33 and the documents held by the augers 55 and 56. The limitation on the current supplied to the motor 59, and on the pressure that may be applied to the idler pulley 39 without triggering the pressure switch 40, combine to limit the total pressure that the stack of documents may apply against the feed means 33.

Having described the preferred embodiment of the invention, it will be obvious to those skilled in the art that various modifications may be made therein without departing from the spirit and scope of the invention. It is to be expressly understood that the scope of the invention is not to be limited to the disclosed embodiment, but only as defined by the appended claims.

What is claimed is:

1. A document feeding apparatus having an inclined vibratile hopper for receiving a stack of documents edgewise and for advancing said stack towards a document feed means for serial removal from said hopper, said hopper including rotatable auger means for dividing said stack into packs and for advancing successive packs toward said document feed means, said auger means having thread means having a pitch and diameter at an intermediate portion between the ends of said thread maans of sufficient width to allow said successive packs of documents to be vibrationally aligned while said auger is being rotated, said pitch and said diameter of said thread means both tapering from said intermediate portion towards the ends of said thread means to successively facilitate (1) the division of said stack into packs at one end of said thread means, (2) the mutual alignment of the documents in each pack at said intermediate portion, and (3) the compression of said packs while advancing said documents towards the document feed means at the other end of said thread means.

2. An apparatus as defined in claim 1 in which said auger means comprises a plurality of parallel augers.

3. The apparatus as defined in claim 2 wherein said plurality of augers comprises a plurality of variably pitched and diametered augers positioned for cooperation with the bottom and front edges of the documents comprising said stack.

4. An apparatus as defined in claim 1 wherein said hopper is provided with a base and with a wall substantially orthogonal to said base and wherein said auger means simultaneously advances said packs of documents towards the document feed means and urges said documents to edgewise abut said wall.

5. The apparatus as defined in claim 4 wherein said wall is located on the side of the hopper towards which said documents are removed.

6. An apparatus as defined in claim 1 further comprising means for rotating said auger means and means responsive to document feed means for controlling the rate of rotation of said auger means to control the rate of flow of documents to the document feed means.

7. An apparatus for feeding documents from a stack including a hopper for holding the stack and document feed means for serially feeding the documents from the stack, in combination therewith the improvement comprising an auger adapted to divide the stack into packs and to advance successive packs toward the document feed means, said auger having thread means having a pitch and diameter at an intermediate portion between the ends of said thread means of sufficient width to allow said successive packs of documents to be vibrationally aligned while said auger is being rotated, said pitch and said diameter of said thread means both tapering from said intermediate portion towards the ends of said thread means to successively facilitate (1) the division of said stack into packs at one end of said thread means, (2) the mutual alignment of the documents in each pack at said intermediate portion, and (3) the compression of said packs at the other end of said thread means while advancing said documents through the document feed apparatus.

8. A document feeding apparatus having a hopper comprising an inclined vibratile base portion for receiving edgewise a stack of documents and for advancing said stack towards a document feed means, said hopper including means for advancing said documents, said means having a thread means including:

a. a first portion of a reduced pitch and diameter for serially dividing said stack of advancing documents into a plurality of separate document packs having a predetermined interdocumental pressure, b. a second portion of a larger pitch and diameter, said second portion for relieving said predetermined interdocumental pressure within said separate document packs and for substantially separating the documents comprising said packs, and c. a third portion of reduced pitch and diameter for re-establishing interdocumental pressure within said separate packs.

9. The document feeding apparatus as defined in claim 8 wherein the improvement comprises at least two identical rotatable augers disposed for cooperation with the bottom edges of said documents and a rotatable auger disposed for cooperation with document edges forming one side of said stacks of documents, said augers being of predetermined variable pitch and diameter, having a narrow pitched and diametered first and a third portion and an intermediate wide pitched and diametered second portion.

10. In a document feeding apparatus having an inclined vibratile hopper for receiving a stack of documents edgewise and for advancing said stack towards a document feed means for serial removal from said hopper, and further having biasing means disposed within said hopper for urging said stack of documents in the direction of and into frictional contact with the document feed means, the improvement comprising rotatble auger means disposed within said hopper, said auger means having thread means with a pitch and diameter at an intermediate portion between the ends of said thread means of sufficient width to allow said documents to be vibrationally aligned, said pitch and diameter tapering from said intermediate portion towards the ends of said thread means to progressively divide said stack into packs, and mutually align the documents in each pack, and compress said packs while advancing said documents towards the document feed means.

* * * * *